United States Patent [19]

Dank

[11] Patent Number: 4,777,476

[45] Date of Patent: Oct. 11, 1988

[54] SECURITY FENCE

[75] Inventor: Zvi Dank, Herzlia, Israel

[73] Assignee: Magal Security Systems, Limited, Israel

[21] Appl. No.: 46,735

[22] Filed: May 7, 1987

[30] Foreign Application Priority Data

May 8, 1986 [IL] Israel ..... 78728

[51] Int. Cl.[4] ..... G08B 13/00

[52] U.S. Cl. ..... 340/541; 340/550; 340/555

[58] Field of Search ..... 340/541, 550, 555; 350/96.23

[56] References Cited

U.S. PATENT DOCUMENTS

| | | | |
|---|---|---|---|
| 4,234,875 | 11/1980 | Williams | 340/550 |
| 4,275,294 | 6/1981 | Davidson | 340/555 X |
| 4,292,628 | 9/1981 | Sadler | 340/555 X |
| 4,293,778 | 10/1981 | Williams | 340/550 X |
| 4,307,386 | 12/1981 | Bridge | 340/555 |
| 4,367,460 | 1/1983 | Hodara | 340/550 |
| 4,399,430 | 8/1983 | Kitchen | 340/550 |
| 4,436,368 | 3/1984 | Keck | 340/555 X |
| 4,450,434 | 5/1984 | Nielsen et al. | 340/550 X |
| 4,538,527 | 9/1985 | Kitchen | 340/550 X |
| 4,558,308 | 12/1985 | Ciordinik et al. | 340/550 |
| 4,574,192 | 3/1986 | Kitagawa et al. | 350/96.23 X |
| 4,586,030 | 4/1986 | Klostermann | 340/550 |
| 4,680,573 | 7/1987 | Ciordinik et al. | 340/541 |

FOREIGN PATENT DOCUMENTS

| | | | |
|---|---|---|---|
| 2038060 | 7/1980 | United Kingdom | 340/550 |
| 2039683 | 8/1980 | United Kingdom | 340/550 |
| 2046971 | 11/1980 | United Kingdom | 340/550 |
| 2062321 | 5/1981 | United Kingdom . | |
| 2077471 | 12/1981 | United Kingdom . | |
| 2091874 | 8/1982 | United Kingdom | 340/541 |
| 2098770 | 11/1982 | United Kingdom | 340/556 |

*Primary Examiner*—Glen R. Swann, III
*Assistant Examiner*—Thomas J. Mullen, Jr.
*Attorney, Agent, or Firm*—Nixon & Vanderhye

[57] ABSTRACT

A security fence including a multiplicity of rigid bar elements disposed in a fence configuration, an optical fiber extending through at least some of the hollow rigid bar elements and apparatus for providing predetermined bending of the optical fiber in response to bending of at least some of the rigid bar elements by at least a given amount.

15 Claims, 2 Drawing Sheets

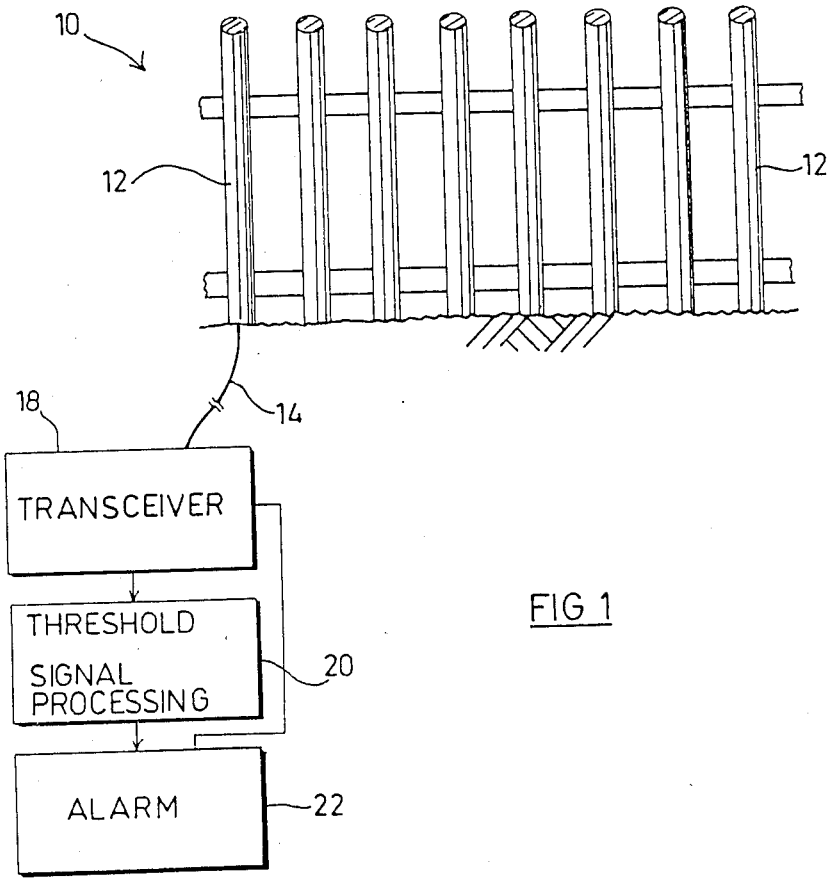
FIG 1
FIG 2
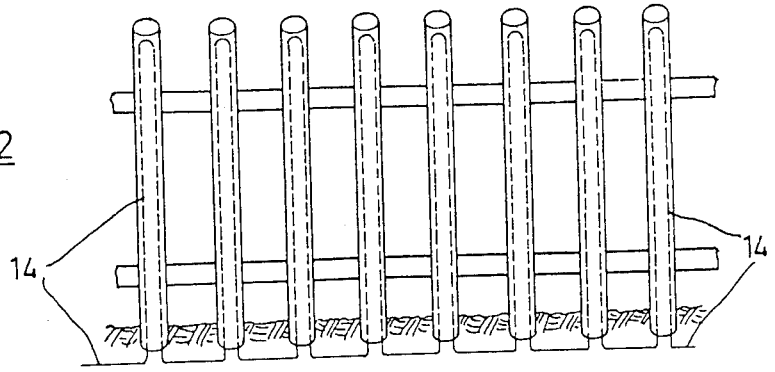

SECURITY FENCE

FIELD OF THE INVENTION

The present invention relates to security fences generally and more particularly to security fences having a intrusion sensing capability.

BACKGROUND OF THE INVENTION

Security fences of various types are known in the patent literature and available on the market. These include taut-wire fence systems which employ tensionsed wires mounted onto motion sensors, whereby an attempt to cut or spread apart the wires results in an alarm indication of the approximate location of the attempted intrusion.

There are also known a variety of security barriers which employ a fiber optics sensing apparatus. U.K. published patent application No. 2,098,770 describes a security barrier structure comprising a lattice of hollow tubular members through which fiber optic cable is threaded. An attempt to break through the barrier breaks or distorts the fiber by overtensioning same, thus causing a sensible attenuation of the an optical signal transmitted through the cable.

U.K. published patent application Nos. 2,038,060; 2,046,971; and 2,062,321 and U.S. Pat. Nos. 4,292,628 and 4,399,430 all show security applications, wherein an alarm indication is provided by breakage of an optical fiber. U.K. published patent application No. 2,077,471 shows a security application wherein a pressure sensitive fiber optic composite cable is provided.

SUMMARY OF THE INVENTION

The present invention seeks to provide a reliable security fence of the parallel bar type which inludes a fiber optics intrusion detection capability.

There is thus provided in accordance with a preferred embodiment of the present invention a security fence comprising a multiplicity of rigid bar elements disposed in a fence configuration, at least one of the rigid bar elements comprising apparatus for providing predetermined bending of an optical fiber in response to bending of the rigid bar element by at least a given amount.

For the purposes of this patent application, "bending" includes microbending.

Further in accordance with an embodiment of the present invention, the security fence comprises optical fiber apparatus disposed in a plurality of the rigid bar elements, apparatus for transmitting an optical signal through the optical fiber apparatus and apparatus for detecting the existence and location of bending in the optical fiber apparatus by means of sensed attenuation, phase change, signal reflection, polarization, wave length change, or any combination of the foregoing in the transmitted optical signal.

Additionally in accordance with a preferred embodiment of the invention, the apparatus for providing predetermined bending is operative to provide microbending of the optical fiber.

Further in accordance with a preferred embodiment of the present invention, the apparatus for bending comprises at least first and second optical fiber securing elements disposed within the rigid bar and arranged so as not to be displaced in response to bending of the rigid bar up to a given amount. At least one intermediate optical fiber securing element disposed intermediate the at leat first and second optical fiber securing elements and arranged to be displaced in response to bending of the rigid bar, whereby bending of the rigid bar causes displacement of the at least one intermediate element relative to the at least first and second elements, producing sensible bending of the optical fiber.

BRIEF DESCRIPTION OF THE DRAWINGS

The present invention will be understood and appreciated more fully from the following detailed description, taken in conjunction with the drawings in which:

FIG. 1 is a pictorial illustration of a security fence system constructed and operative in accordance with a preferred embodiment of the present invention;

FIG. 2 is an illustration of the arrangement of optical fibers in a portion of the security fence of FIG. 1.

DETAILED DESCRIPTION OF A PREFERRED EMBODIMENT

Figure 3A:
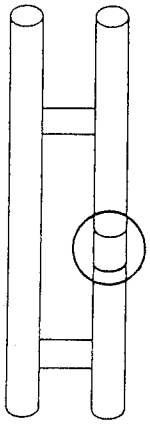
FIGS. 3A–3B and 3C–3D are illustrations of a pair of rigid bars and enlarged sections thereof under conditions of no bending and bending respectively.

Reference is now made to FIGS. 1 and 2, which illustrate a security fence system constructed and operative in accordance with a preferred embodiment of the present invention. The security fence system typically comprises a conventional type of security barrier, such as a parallel bar type fence 10, as shown, which comprises a plurality of generally upstanding spaced bars 12.

According to a preferred embodiment of the present invention, bars 12 are formed of suitably thick steel, plastic or any other material having a desired cross section and are hollow. According to the illustrated embodiment, an optical fiber 14 is threaded serially up and down through a plurality of adjacent bars 12, as shown in FIG. 2. Alternatively any other desired configuration of optical fiber 14 may be employed.

A signal transceiver 18, such as a TEK fiber optic TDR cable tester, manufactured by Tektronix, of Portland, Oreg., U.S.A., hereinafter referred to as "OTDR", is connected to an end of the fiber 14 for providing a suitable optical signal for passage therethrough and receiving the reflected signal therefrom. Alternatively, in place of the OTDR, a spectrum analyzer having a built in transceiver, such as a TEK portable spectrum analyzer 490 series, also available from Tektronix, may be employed. Apparatus of this type may be used to provide output indications of the existence and approximate location of bending of the optical fiber and resultant attenuation, phase change and signal reflections, or any one or more of the foregoing.

The output of transceiver 18 may be provided to threshold and signal processing circuitry 20 for automatic determination of whether an alarm indication exists based on predetermined thresholds or other criteria. Alternatively, an operator may monitor the transceiver 18 in order to perceive an alarm indication. The output of transceiver and of processing circuitry 20 may be supplied to alarm indication circuitry 22, which provides a suitable alarm output indication of the existence and approximate location of the attempted intrusion.

The signal processing circuitry 20 may include means for classifying alarm indications based on the time rate of change of analog bending parameters sensed by the means for detecting.

Reference is now made to FIGS. 3A–3D which illustrate an apparatus for providing bending of the optical signals passing through optical fiber 14 in response to bending of bars 12. Disposed interiorly of many or all of bars 12 and in generally parallel spaced relationship thereto is a rigid support rod 24, which is arranged so as not to be bent in response to bending of bar 12, which is less than a predetermined amount, such as 25 degrees.

Fixedly mounted on support rod 24 are a plurality of spaced optical fiber securing elements 26 having apertures 28 which receive the optical fiber 14, with relatively little transverse play. Typically, securing elements 26 are separated along the length of the optical fiber by one centimeter and extend over part or most of the length of bar 12.

Intermediate each pair of securing elements 26 there is provided an intermediate element 30, which is configured and arranged to peripherally engage the interior surface of bar 12, so as to be displaced when bar 12 is bent. Intermediate element 30 is formed with an optical fiber engaging aperture 32, which normally, i.e. when the bar 12 is unbent, is arranged in registration with apertures 38 such that the optical fiber 14 extends therethrough in a generally straight line, as shown in FIGS. 3A–3B.

Intermediate element 30 is also provided with a large aperture 34 through which extend support rod 24 and the looped back portion of optical fiber 14. The arrangement of aperture 34 is such that under bending of bar 12 within a predetermined range for which intrusion detection is required, support rod 24 does not contact intermediate element 30 and thus does not restrict its movement.

Figure 3C:
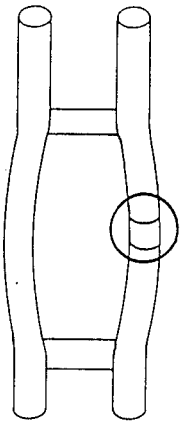
Figure 3B:
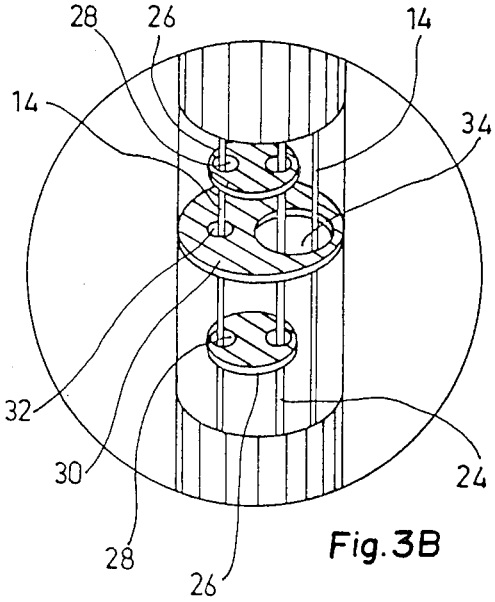
Figure 3D:
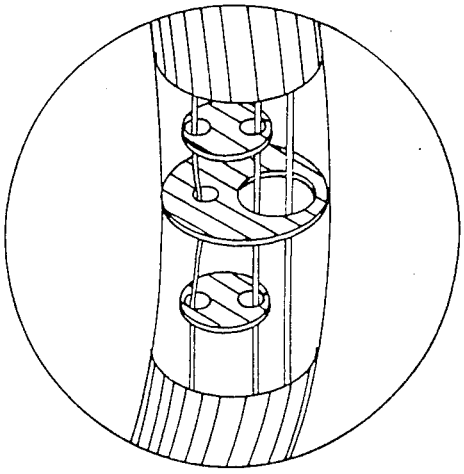

Referring now to FIGS. 3C–3D, it is seen that when a bar 12 is bent, intermediate element 30 is displaced laterally, with respect to the axis of optical fiber 14, while securing elements 26, which are mounted on support rod 24, are not bent. As a result apertures 28 and 32 are no longer in registration, and cause bending of the optical fiber 14.

The bending of the optical fiber 14 produced by the bending apparatus, an example of which is illustrated in FIGS. 3A–3D, is sensed by receiver 18, spectrum analyzer 20 and alarm indication circuitry 22 to provide an alarm indication of the existence and general location of the sensed bending.

According to a preferred embodiment of the present invention, optical fiber 14 is directly coupled to transceiver 18. Thus, it may be appreciated that a single optical fiber is operative both for detection and for connection.

It will be appreciated by persons skilled in the art that the present invention is not limited to what has been particularly shown and described hereinabove. For example, the apparatus shown in FIGS. 3A–3D may be replaced by any other suitable bending responsive apparatus. The scope of the present invention is defined only by the claims which follow:

I claim:

1. A security fence comprising:

a multiplicity of hollow rigid bar elements disposed in a fence configuration;

an optical fiber extending through at least some of said hollow rigid bar elements; and means for providing predetermined bending of said optical fiber in response to bending of at least some of the rigid bar elements by at least a given amount, said means including optical fiber supporting means disposed within each of the rigid bar elements containing said optical fiber and arranged so as not to be displaced in response to bending of the corresponding rigid bar element up to a given amount.

2. Apparatus according to claim 1 and also comprising:

means for transmitting an optical signal through the optical fiber; and means for detecting the existence and approximate location of bending in the optical fiber by means of sensed changes in the optical signal.

3. Apparatus according to claim 2 and wherein said means for transmitting and means for detecting are embodied in OTDR apparatus.

4. Apparatus according to claim 2 and wherein said means for transmitting and means for detecting are embodied in spectrum analyzer apparatus.

5. Apparatus according to claim 2 and wherein said means for detecting comprise attenuation detection means.

6. Apparatus according to claim 2 and wherein said means for detecting comprise phase change detection means.

7. Apparatus according to claim 2 and wherein said means for detecting comprises signal reflection detection means.

8. Apparatus according to claim 2 and wherein said means for detecting comprise wave length change detection means.

9. Apparatus according to claim 2 and wherein said means for detecting comprises polarization detection means.

10. Apparatus according to claim 2 and wherein said optical fiber is directly coupled to said means for transmitting and means for detecting.

11. Apparatus according to claim 2 and wherein said means for detecting is operative to provide an output indication of the existence and approximate location of an intrusion.

12. Apparatus according to claim 2 and wherein said means for detecting includes means for classifying alarm indications based on the time rate of change of analog bending parameters sensed by the means for detecting.

13. Apparatus according to claim 1 and wherein the means for providing predetermined bending is operative to provide microbending of the optical fiber.

14. A security fence comprising:

a multiplicity of rigid bar elements disposed in a fence configuration;

an optical fiber associated with at least some of said rigid bar elements; and means for providing predetermined bending of said optical fiber in response to bending of at least some of the rigid bar elements by at least a given amount, and wherein said means for providing predetermined bending comprises:

at least first and second optical fiber securing elements supporting said optical fiber and disposed within eac of the rigid bar elements associated with said optical fiber and arranged so as not to be displaced in response to bending of the corresponding rigid bar element up to a given amount; and at least one intermediate optical fiber securing element disposed intermediate the at least first and second optical fiber securing elements and arranged to be displaced in response to bending of the corresponding rigid bar element, whereby bending of the corresponding rigid bar element causes displacement of the at least one intermediate element relative to the at least first and second elements, producing sensible bending of the optical fiber.

15. Apparatus according to claim 14 and wherein said means for providing predetermined bending further comprises a support rod supporting said optical fiber securing elements and arranged so as not to be displaced in response to bending of the corresponding rigid bar element up to a given amount.

* * * * *